US010749289B2

(12) United States Patent
Long

(10) Patent No.: US 10,749,289 B2
(45) Date of Patent: Aug. 18, 2020

(54) ELECTRICAL CONNECTOR WITH DIFFERENT LENGTH SIGNAL TERMINALS HAVING CORRECTION FEATURES FOR DELAYED SKEW

(71) Applicant: LOTES CO., LTD, Keelung (TW)

(72) Inventor: Quan Long, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 16/535,441

(22) Filed: Aug. 8, 2019

(65) Prior Publication Data

US 2020/0059032 A1 Feb. 20, 2020

(30) Foreign Application Priority Data

Aug. 17, 2018 (CN) ..... 2018 1 0937802

(51) Int. Cl.

| | |
|---|---|
| ***H01R 13/514*** | (2006.01) |
| ***H01R 4/02*** | (2006.01) |
| ***H01R 12/72*** | (2011.01) |
| ***H01R 13/40*** | (2006.01) |
| ***H01R 13/6461*** | (2011.01) |
| ***H01R 13/6594*** | (2011.01) |

(Continued)

(52) U.S. Cl.

CPC ..... *H01R 13/514* (2013.01); *H01R 4/02* (2013.01); *H01R 12/724* (2013.01); *H01R 13/40* (2013.01); *H01R 13/6461* (2013.01); *H01R 13/6594* (2013.01); *H01R 13/6597* (2013.01); *H01R 43/20* (2013.01)

(58) Field of Classification Search

CPC .. H01R 13/514; H01R 13/40; H01R 13/6461; H01R 13/6594; H01R 4/02; H01R 12/724

USPC ..... 439/541.5

See application file for complete search history.

(56) References Cited

U.S. PATENT DOCUMENTS

| | | | | |
|---|---|---|---|---|
| 6,899,566 | B2 * | 5/2005 | Kline | H01R 13/518 439/607.56 |
| 7,794,278 | B2 * | 9/2010 | Cohen | H01R 12/727 439/108 |

(Continued)

FOREIGN PATENT DOCUMENTS

| | | |
|---|---|---|
| CN | 101779340 B | 2/2013 |
| CN | 102694308 B | 9/2014 |

(Continued)

*Primary Examiner* — Peter G Leigh

(74) *Attorney, Agent, or Firm* — Locke Lord LLP; Tim Tingkang Xia, Esq.

(57) ABSTRACT

An electrical connector includes: an insulating body provided with at least one groove, where at least one protruding block is provided in the groove; and at least one pair of signal terminals adjacently provided, accommodated in the insulating body and exposed in the groove. The pair of signal terminals includes a long signal terminal and a short signal terminal. Each of the long signal terminal and the short signal terminal has a first section and a second section bending and extending from one end of the first section. A length of the long signal terminal is greater than a length of the short signal terminal. An area of the short signal terminal covered by the protruding block is larger than an area of the long signal terminal covered by the protruding block, which is equivalent to setting an obstruction for the short signal terminal.

17 Claims, 10 Drawing Sheets

(51) Int. Cl.
*H01R 13/6597* (2011.01)
*H01R 43/20* (2006.01)

(56) References Cited

U.S. PATENT DOCUMENTS

| | | | | |
|---|---|---|---|---|
| 8,172,614 | B2 * | 5/2012 | Kirk | H01R 13/6585 439/607.07 |
| 9,484,674 | B2 * | 11/2016 | Cartier, Jr. | H01R 13/658 |
| 9,520,689 | B2 * | 12/2016 | Cartier, Jr. | H01R 43/16 |
| 9,722,339 | B2 * | 8/2017 | Tamaki | H01R 13/405 |
| 2016/0056580 | A1 * | 2/2016 | Kondo | H01R 13/6473 439/626 |
| 2017/0093093 | A1 * | 3/2017 | Cartier, Jr. | H01R 43/16 |

FOREIGN PATENT DOCUMENTS

| | | | |
|---|---|---|---|
| CN | 204706664 | * | 10/2015 |
| CN | 206461128 | U | 9/2017 |
| CN | 207572569 | * | 7/2018 |

* cited by examiner

ELECTRICAL CONNECTOR WITH DIFFERENT LENGTH SIGNAL TERMINALS HAVING CORRECTION FEATURES FOR DELAYED SKEW

CROSS-REFERENCE TO RELATED PATENT APPLICATION

This non-provisional application claims priority to and the benefit of, pursuant to 35 U.S.C. § 119(a), patent application Serial No. CN201810937802.3 filed in China on Aug. 17, 2018. The disclosure of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector, and particularly to an electrical connector capable of improving high frequency characteristics.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Along with the development of the current science and technology, there are more types of electrical connectors and the application field of the electrical connector becomes wider, resulting in higher requirements on the electrical connector, including high-speed transmission and miniaturization design of the electrical connector, and the like. Therefore, under a certain environment, the electrical connector needs to be designed into a side vertical type to adapt to a special environment.

A conventional side vertical type electrical connector is soldered to a circuit board, and generally includes an insulating body, terminals accommodated in the insulating body, and an outer shell wrapping an exterior of the insulating body. Because the electrical connector is designed to be as the side vertical type, for normal mating with a mating connector, the front ends of the terminals are located on a same plane. Further, because the soldering pins of the terminals also need to be soldered to a same plane of the circuit board, it is necessary to bend the terminals. In this way, a total length of each of the terminals is different. When the terminals contain a differential signal pair, delay skew is likely to be generated because of a length difference. That is, when receiving signals at the same time, a shorter terminal can transmit the received signal to a terminal (circuit board) faster than a longer terminal does. In addition, a higher signal transmission frequency indicates a larger skew, which results in high frequency characteristics being affected.

Therefore, a heretofore unaddressed need to design a new electrical connector exists in the art to address the aforementioned deficiencies and inadequacies.

SUMMARY

The present invention is directed to an electrical connector, and in particularly to an electrical connector capable of improving high frequency characteristics.

In order to achieve the foregoing objective, the present invention adopts the following technical solutions:

An electrical connector includes: an insulating body; and at least one pair of signal terminals adjacently provided and accommodated in the insulating body, wherein each of the at least one pair of signal terminals includes a long signal terminal and a short signal terminal, each of the long signal terminal and the short signal terminal has a first section and a second section bending and extending from one end of the first section, a length of the long signal terminal is greater than a length of the short signal terminal, and an area of the long signal terminal covered by the insulating body is smaller than an area of the short signal terminal covered by the insulating body.

In certain embodiments, the first section of the short signal terminal and the first section of the long signal terminal are correspondingly provided in parallel, and the second section of the short signal terminal and the second section of the long signal terminal are correspondingly provided in parallel.

In certain embodiments, the insulating body is provided with at least one groove, at least one protruding block is provided in the groove, the long signal terminal and the short signal terminal are exposed in the groove, and an area of the short signal terminal covered by the protruding block is larger than an area of the long signal terminal covered by the protruding block.

In certain embodiments, the electrical connector includes a plurality of pairs of signal terminals, wherein the pairs of signal terminals are arranged from inside to outside in a transverse direction, a length of a short signal terminal located at an outer side is greater than a length of a short signal terminal located at an inner side, and a proportion of the short signal terminal located at the inner side covered by the insulating body is larger than a proportion of the short signal terminal located at the outer side covered by the insulating body.

In certain embodiments, proportions of the short signal terminals covered by the insulating body are gradually increased from outside to inside.

Further, the present invention provides an electrical connector, which includes: an insulating body, provided with at least one groove, wherein at least one protruding block is provided in the groove; and at least one pair of signal terminals adjacently provided, accommodated in the insulating body and exposed in the groove, wherein each of the at least one pair of signal terminals includes a long signal terminal and a short signal terminal, each of the long signal terminal and the short signal terminal has a first section and a second section bending and extending from one end of the first section, a length of the long signal terminal is greater than a length of the short signal terminal, and an area of the short signal terminal covered by the protruding block is larger than an area of the long signal terminal covered by the protruding block.

In certain embodiments, the protruding block only covers the short signal terminal and does not cover the long signal terminal.

In certain embodiments, the protruding block covers a portion of the long signal terminal.

In certain embodiments, a portion of the short signal terminal is exposed in the groove, and the protruding block does not completely cover the portion of the short signal terminal.

In certain embodiments, the first section of the short signal terminal comprises a contact portion and a first connecting portion extending backward from the contact portion, the groove comprises a first groove, the first connecting portion is exposed in the first groove, and an area of the first connecting portion covered by the protruding block is gradually increased from front to back.

In certain embodiments, the first section of the short signal terminal comprises a contact portion and a first connecting portion extending backward from the contact portion, the groove comprises a first groove, the first connecting portion is exposed in the first groove, and a rear end of the first connecting portion is located closer to a side edge of the protruding block relative to a front end of the first connecting portion.

In certain embodiments, the groove comprises a first groove, the protruding block comprises a first protruding block, the first protruding block is located in the first groove, and the first protruding block linearly extends from front to back so as to connect two inner surfaces of the first groove opposite to each other.

In certain embodiments, the short signal terminal located at an outermost side has a width, and more than half of the width is not covered by the protruding block.

In certain embodiments, the groove comprises a first groove and a second groove, a first protruding block and a second protruding block are respectively provided in the first groove and the second groove, and the first protruding block and the second protruding block are staggeredly provided in a front-rear direction and cover a same short signal terminal.

In certain embodiments, the first section of the short signal terminal comprises a contact portion and a first connecting portion extending backward from the contact portion, the first connecting portion extends backward to form a second connecting portion, the first connecting portion is located in the first groove, the second connecting portion is exposed in the second groove, and a distance between a side edge of a front end of the first connecting portion and the first protruding block is greater than a distance between a side edge of the second connecting portion and a side edge of the second protruding block.

In certain embodiments, the first section of the short signal terminal and the first section of the long signal terminal are correspondingly provided in parallel, and the second section of the short signal terminal and the second section of the long signal terminal are correspondingly provided in parallel.

In certain embodiments, the electrical connector includes a plurality of pairs of signal terminals, wherein the insulating body is provided with a plurality of grooves and a plurality of protruding blocks, each of the pairs of the signal terminals is exposed to a corresponding one of the grooves, each of the grooves is provided with a corresponding one of the protruding blocks correspondingly covering a portion of the short signal terminal of a corresponding pair of the signal terminals, the pairs of signal terminals are arranged from inside to outside in a transverse direction, a length of a short signal terminal located at an outer side is greater than a length of a short signal terminal located at an inner side, and an area of the portion of the short signal terminal located at the inner side covered by the corresponding protruding block is larger than an area of the portion of the short signal terminal located at the outer side covered by the corresponding protruding block.

In certain embodiments, areas of the portions of the short signal terminals covered by the protruding blocks are gradually decreased from inside to outside.

In certain embodiments, a proportion of the area of the portion of the short signal terminal located at the inner side covered by the corresponding protruding block is larger than a proportion of the area of the portion of the short signal terminal located at the outer side covered by the corresponding protruding block.

In certain embodiments, proportions of areas of the portions of the short signal terminals covered by the protruding blocks are gradually increased from outside to inside.

Compared with the related art, in the present invention, the insulating body is concavely provided with a plurality of grooves to expose the long signal terminal and the short signal terminal in air, such that a dielectric constant is changed to adjust impedance, so as to improve the high frequency characteristics. Meanwhile, the protruding block is provided in the groove, such that the area of the short signal terminal covered by the protruding block is larger than the area of the long signal terminal covered by the protruding block, which is equivalent to setting an obstruction for the short signal terminal. When the short signal terminal and the long signal terminal simultaneously receive signals, the time for the short signal terminal to transmit the signal can be prolonged, such that the delay skew caused by a length difference of the long signal terminal and the short signal terminal can be eliminated.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
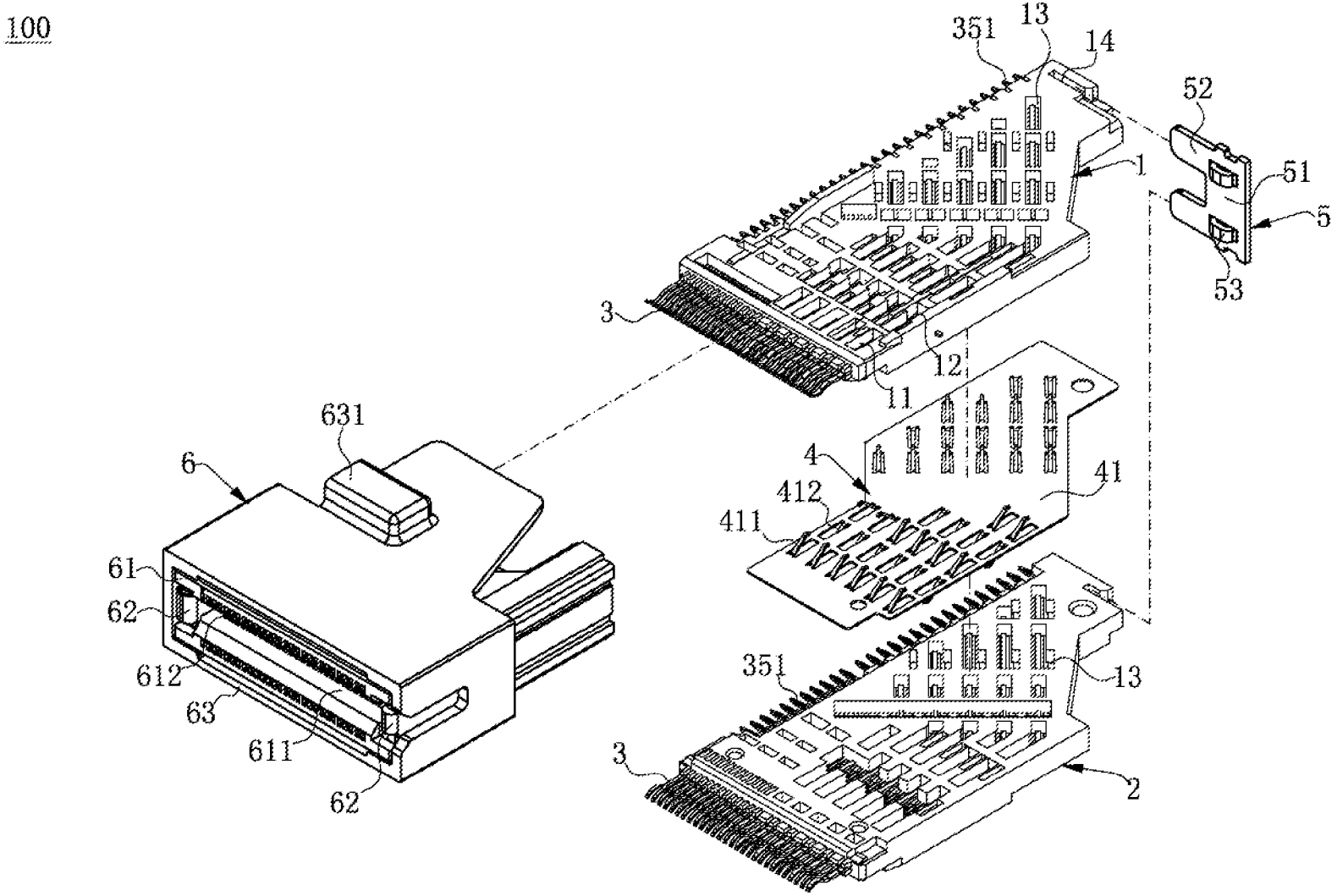
FIG. 1 is a perspective exploded view of an electrical connector according to a first embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-11. In accordance with the purposes of this invention, as embodied and broadly described herein, this invention, in one aspect, relates to an electrical connector.

FIG. 1 to FIG. 9 show an electrical connector 100 according to a first embodiment of the present invention. The electrical connector 100 is soldered onto a circuit board 200, and includes an insulating body (formed by an upper insulating body 1 and a lower insulating body 2), a plurality of terminals 3, a grounding sheet 4, a clamping member 5 and an outer body 6.

Figure 2:
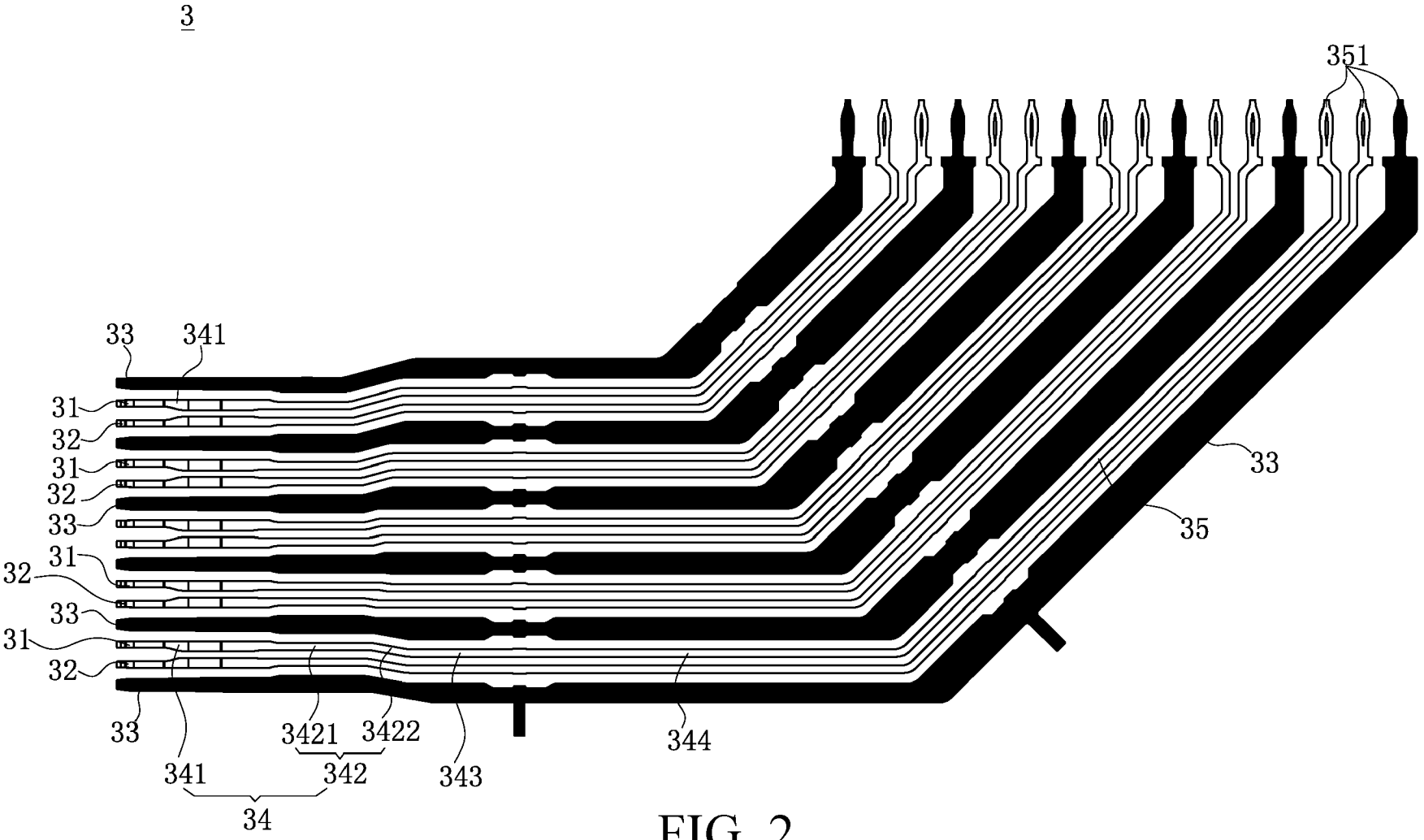
FIG. 2 is an exploded view of some terminals in an upper insulating body in FIG. 1.
Figure 3:
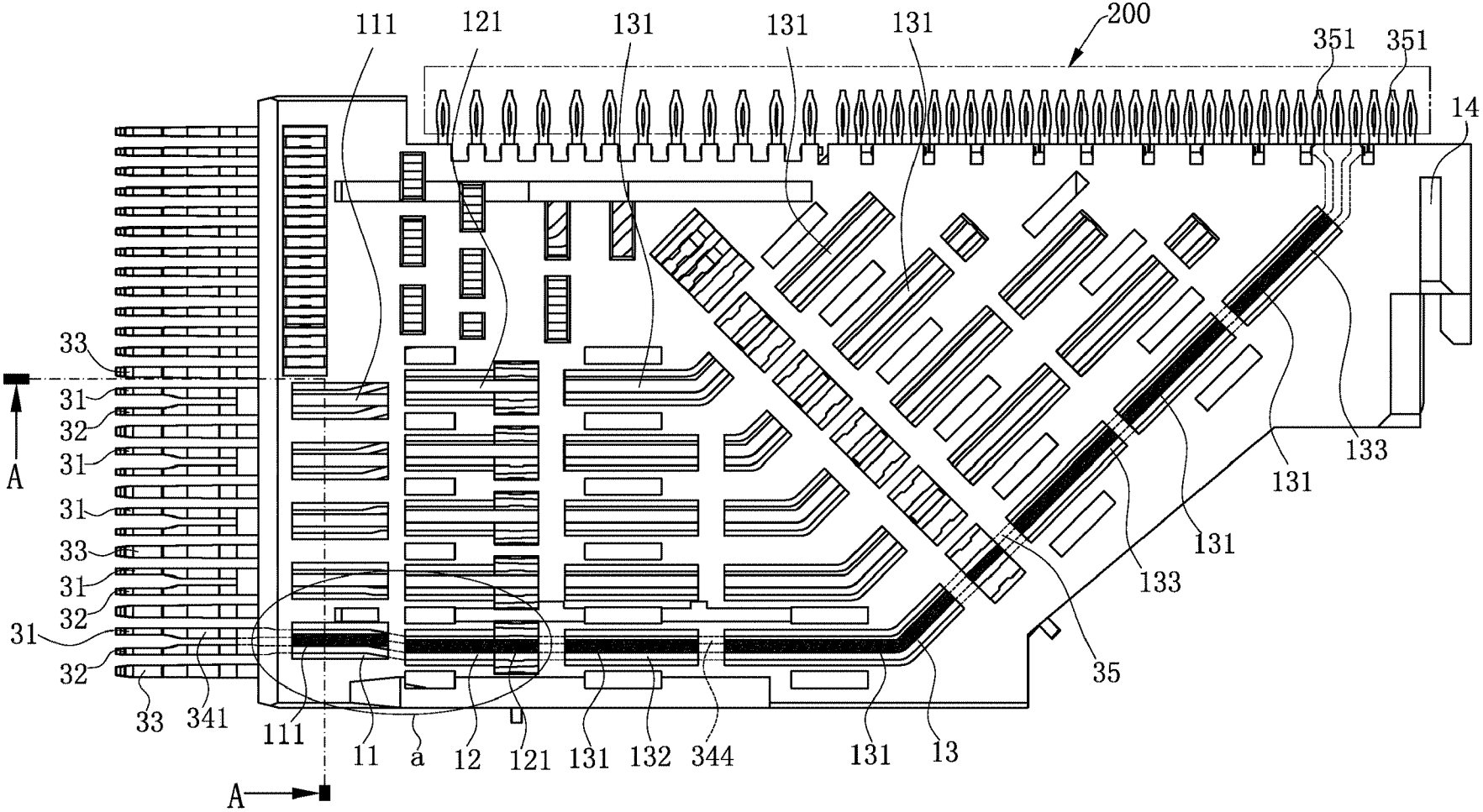
FIG. 3 is a top view of the upper insulating body in FIG. 1.

Referring to FIG. 1 to FIG. 3, the terminals 3 are divided into an upper row and a lower row, and are correspondingly formed in the upper insulating body 1 and the lower insulating body 2 by injection molding. The terminals 3 located in the upper and lower rows are identical in structure, and the terminals 3 located on the upper row are used as an example. The terminals 3 are arranged in a transverse direction, and include a plurality of differential signal terminal pairs and a plurality of grounding terminals 33 adjacently provided with the differential signal terminal pairs. A short signal terminal 31 and a long signal terminal 32 adjacently provided form one differential signal terminal pair. Each of the short signal terminal 31 and the long signal terminal 32 includes a first section 34 and a second section 35 bending at a certain angle and extending from a rear end of the first section 34, and the first section 34 and the second section 35 of each short signal terminal 31 are correspondingly parallel to the first section 34 and second section 35 of the long signal terminal 32. The first section 34 further includes a contact portion 341 located at a front end thereof, a first connecting portion 342 and a second connecting portion 343 extending backward from the contact portion 341 in sequence, and a third connecting portion 344 connecting the second connecting portion 343 to the second section 35. The first connecting portion 342 includes a horizontal portion 3421 and a bending portion 3422 located behind the horizontal portion 3421. A tail end of each second section 35 is provided with a soldering portion 351. The soldering portion 351 of the short signal terminal 31 and the soldering portion 351 of the long signal terminal 32 are located on a same plane. A length of the long signal terminal 32 is greater than a length of the short signal terminal 31 adjacent to the long signal terminal 32. A side of the terminal 3 located closer to a circuit board 200 in a transverse direction is an inner side, and a side of the terminal 3 away from the circuit board 200 is an outer side. The length of the short signal terminals 31 and the length of the long signal terminals 32 are gradually increased from inside to outside.

Figure 4:
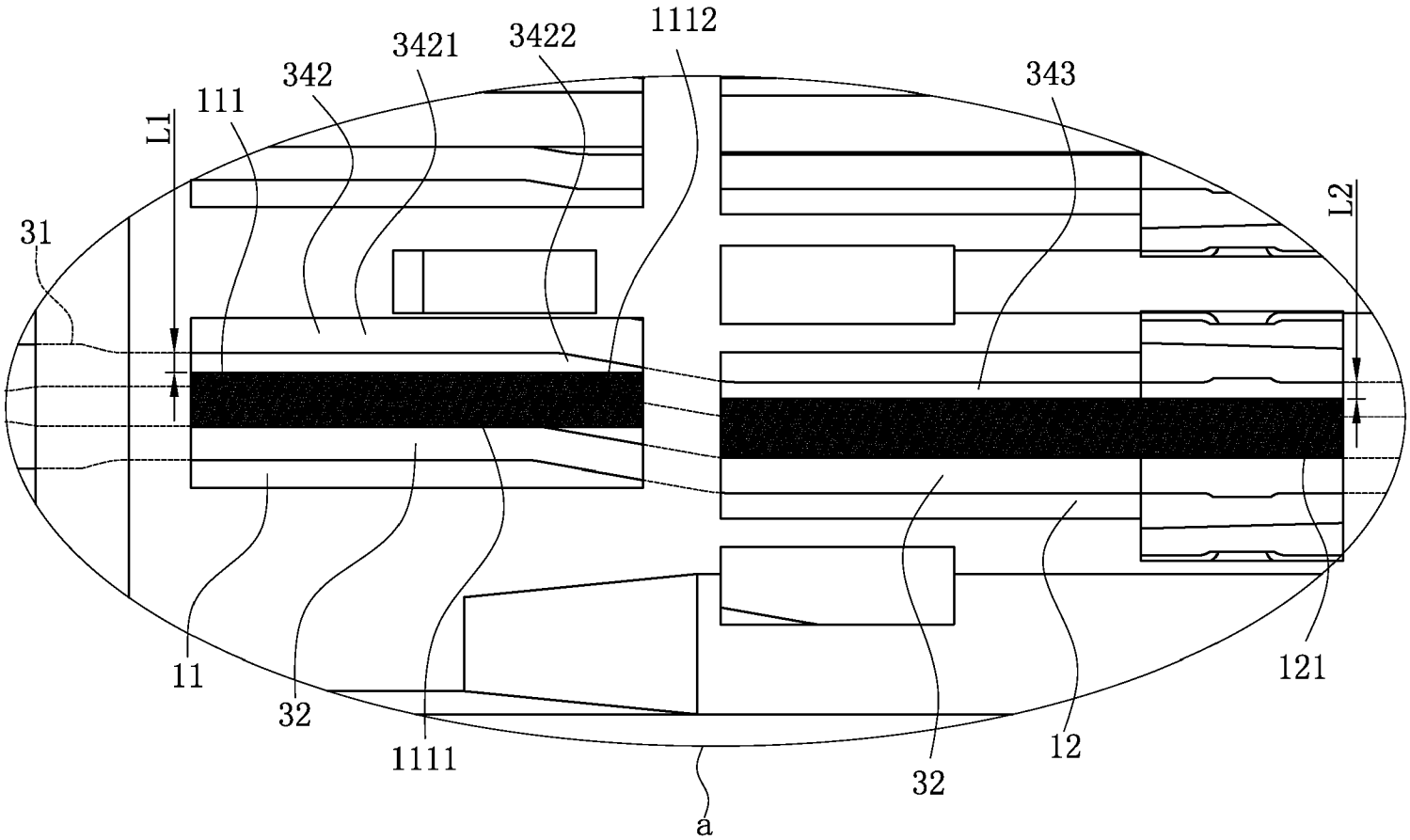
FIG. 4 is a partial enlarged view of FIG. 3.
Figure 5:
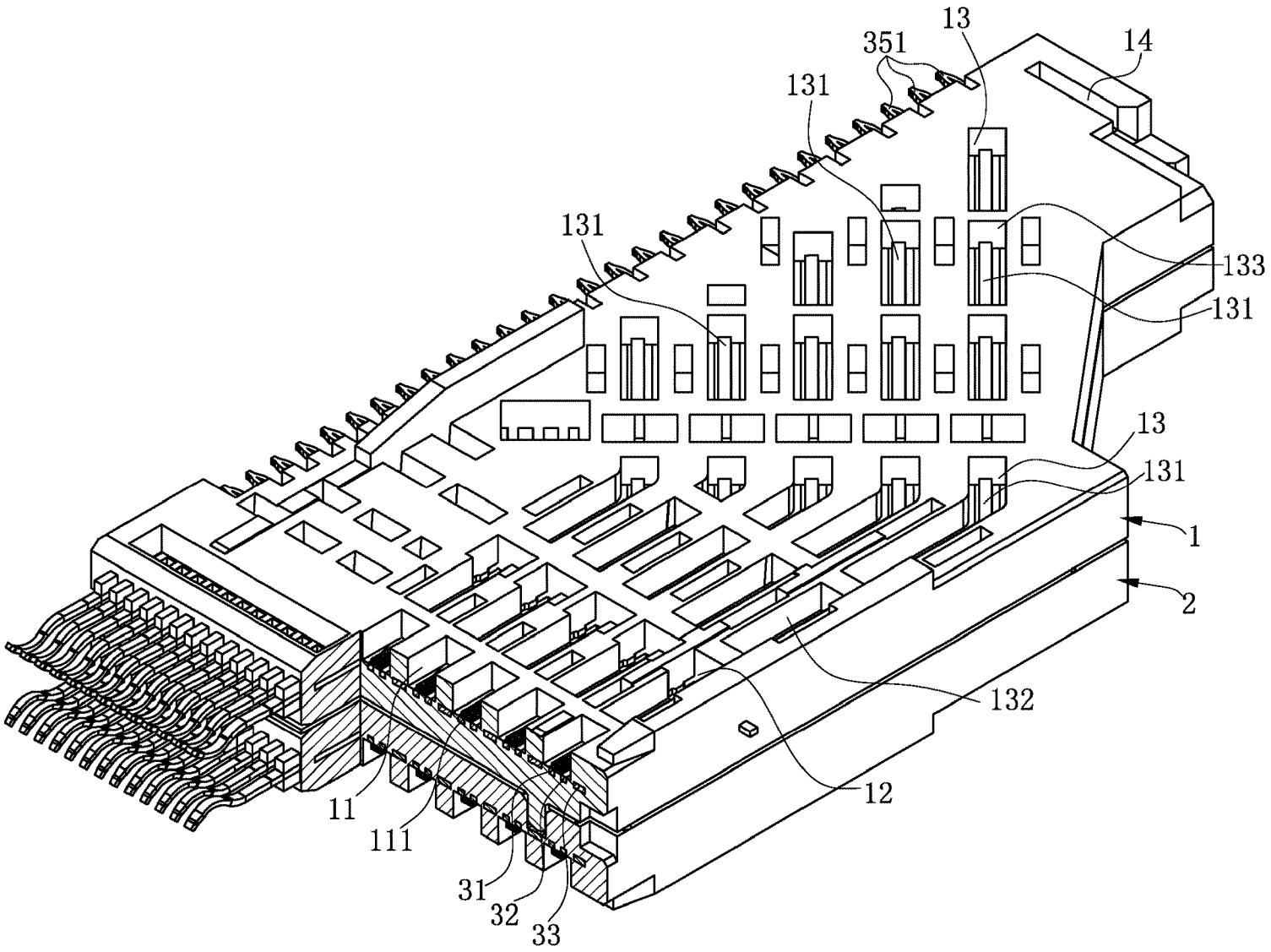
FIG. 5 is a partial sectional view of FIG. 3 along an A-A direction.
Figure 6:
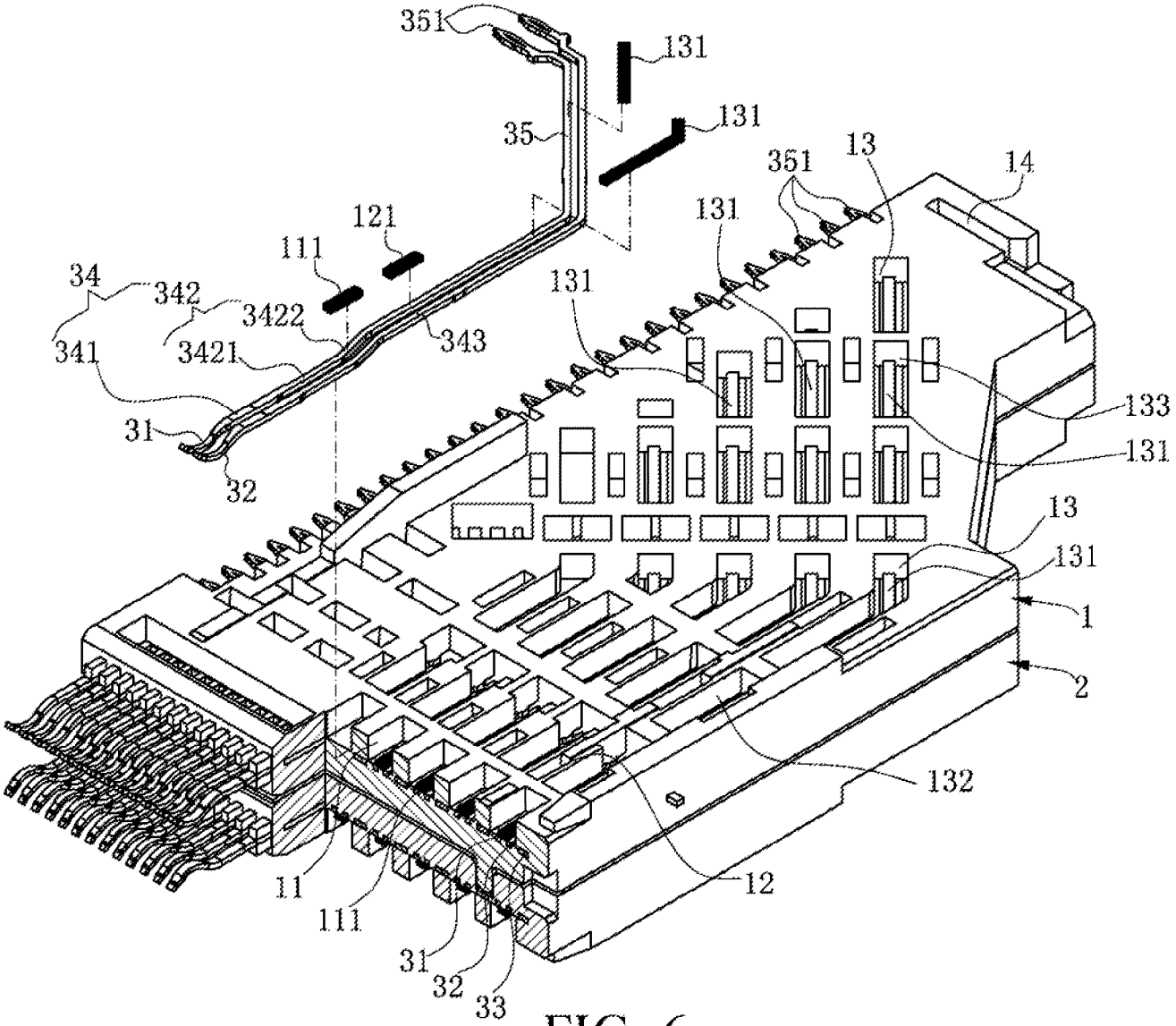
FIG. 6 is a partial exploded view of FIG. 5.

Referring to FIG. 1, FIG. 3, FIG. 5 and FIG. 6, a surface of the upper insulating body 1 is concavely provided with a plurality of grooves. The grooves include five first grooves 11 arranged in the transverse direction, five second grooves 12 located behind the first grooves 11 and staggered with the first grooves 11, a plurality of third grooves 13 located behind the second grooves 12, and a clamping groove 14 located behind the third grooves 13. A first protruding block 111 is provided in each first groove 11. The first protruding block 111 and the upper insulating body 1 are integrally formed. The first protruding block 111 includes a base 1111 and a protruding portion 1112 extending in the transverse direction from the base 1111. The first protruding block 111 linearly extends from front to back so as to connect two inner surfaces of the first groove 11 opposite to each other, and a height of an upper surface of the first protruding block 111 is smaller than a height of an outer surface of the upper insulating body 1. As shown in FIG. 3 and FIG. 4, using the short signal terminal 31 and the long signal terminal 32 located at the outermost side as examples, the first connecting portion 342 is exposed in the first groove 11, and the base 1111 is located between the short signal terminal 31 and the long signal terminal 32 adjacently provided. The protruding portion 1112 only covers a portion of a surface of the first connecting portion 342 of the short signal terminal 31, but does not completely cover the first connecting portion 342 of the short signal terminal 31, and does not cover the long signal terminal 32. A first distance L1 exists between a side edge of a front end of the first connecting portion 342 and a side edge of the protruding portion 1112. A side edge of the bending portion 3422 of the short signal terminal 31 is gradually close to the side edge of the protruding portion 1112 from front to back. Thus, an area of the bending portion 3422 covered by the protruding portion 1112 is gradually increased. The second groove 12 and the first groove 11 are staggeredly provided in a front-rear direction. Each second groove 12 is provided with a second protruding block 121, and the second protruding block 121 and the first protruding block 111 are also staggeredly provided in the front-rear direction. A length of the second groove 12 extending in the front-rear direction is greater than a length of the first groove 11 extending in the front-rear direction. Thus, a length of the second protruding block 121 is also greater than a length of the first protruding block 111. The second connecting portion 343 is exposed in the second groove 12. The second protruding block 121 covers a portion of the second connecting portion 343 of the short signal terminal 31. A second distance L2 exists between a side edge of the second connecting portion 343 and a side edge of the second protruding block 121, and L1 is greater than L2. A third protruding block 131 is provided in each third groove 13, and the third groove 13 is divided into a first segment 132 and a second segment 133. The third connecting portion 344 of the short signal terminal 31 is exposed in the first segment 132 and is partially covered by the third protruding block 131. The second segment 133 is provided along the second section 35. Thus, the second section 35 is exposed in the second segment 133, and the second section 35 of the short signal terminal 31 is partially covered by the third protruding block 131. The lower insulating body 2 has a similar structure to that of the upper insulating body 1, and details are not hereinafter elaborated.

Figure 7:
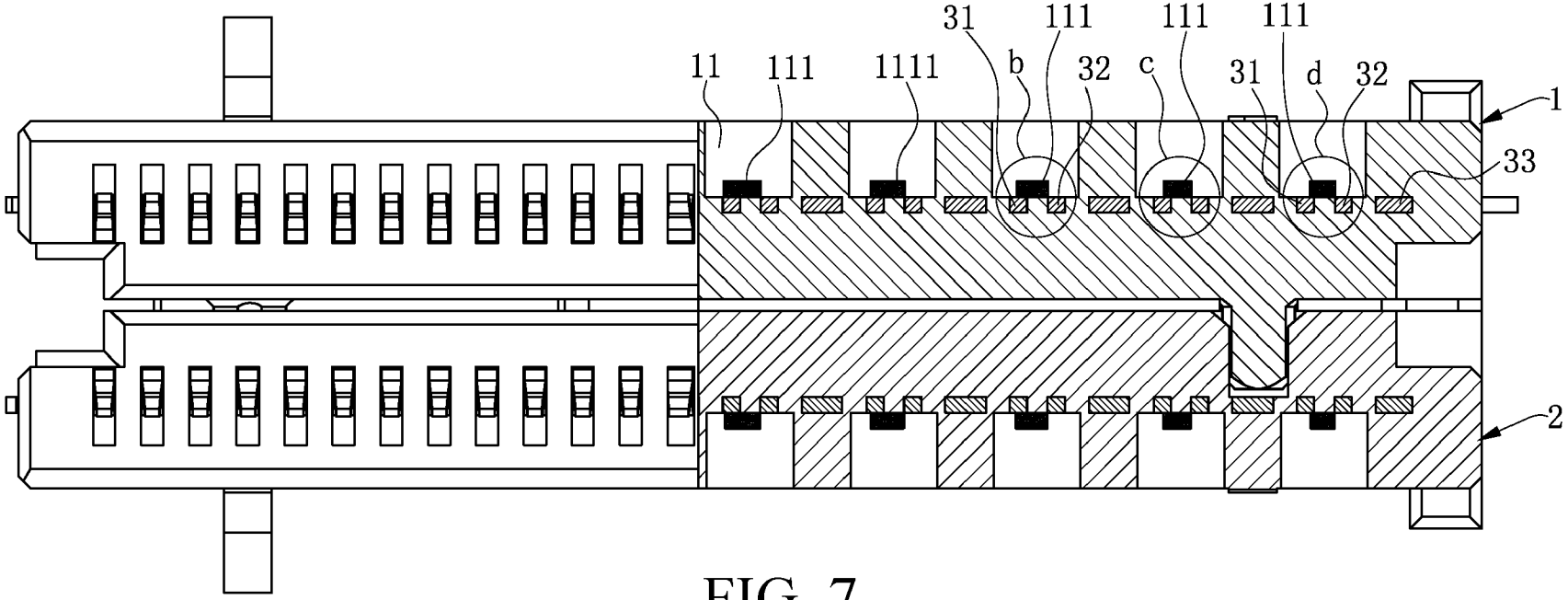
FIG. 7 is a front view of FIG. 5.
Figure 8:
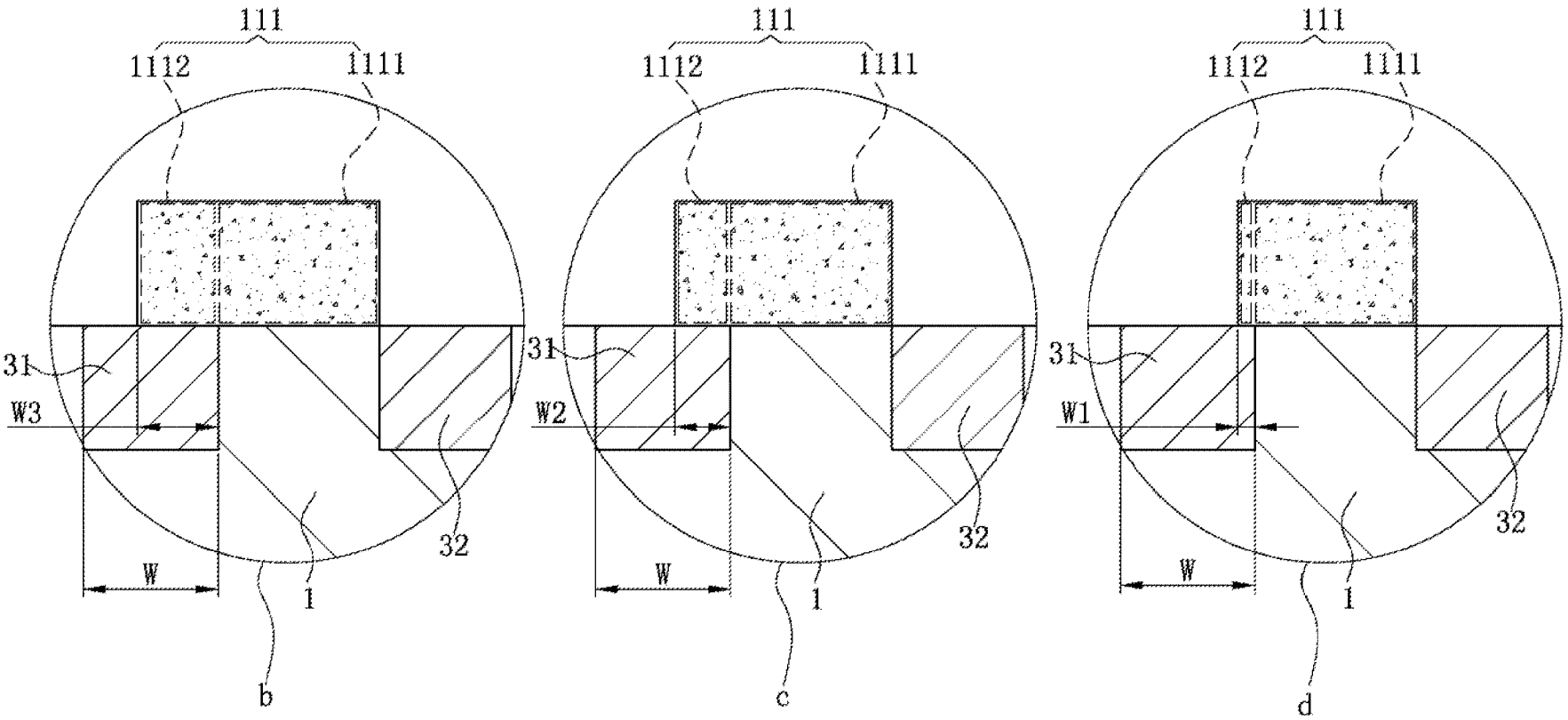
FIG. 8 is a partial enlarged view of FIG. 7.

Referring to FIG. 7 and FIG. 8, each short signal terminal 31 has a width W. Each short signal terminal 31 is covered by the first protruding block 111. Because the widths of the protruding portions 1112 of the first protruding blocks 111 are different, the widths of the short signal terminals 31 being covered are also different. In this embodiment, the quantity of the short signal terminals 31 is five, and the widths of the short signal terminals 31 covered by the protruding portions 1112 from outside to inside are respectively W1, W2, W3, W4 (not shown in the figure) and W5 (not shown in the figure), where W1 is smaller than 0.5 W, and W1<W2<W3<W4<W5. Because the widths of the short signal terminals 31 being covered are different, the areas of the short signal terminals 31 being covered are also different. The areas of the short signal terminals 31 being covered are gradually increased from outside to inside, and the proportions of the short signal terminals 31 being covered are also gradually increased from outside to inside. For example, the proportions of the short signal terminals 31 being covered from outside to inside are respectively 20%, 40%, 60%, 75% and 90% of each of the short signal terminals 31, and the proportions being covered are jointly achieved by all the protruding blocks, including the first protruding blocks 111, the second protruding blocks 121 and the third protruding blocks 131. That is, in another embodiment, proportions of the short signal terminals 31 covered by the first protruding blocks 111, the second protruding blocks 121 and the third protruding blocks 131 may be the foregoing proportions. In another case, the proportions of the short signal terminals 31 being covered by the first protruding blocks 111 from outside to inside may be the same (for example, only 30% is covered), and balance of the foregoing target proportions may be achieved by adjusting only the proportions of the short signal terminals 31 covered by the second protruding blocks 121 and the third protruding blocks 131.

Figure 9:
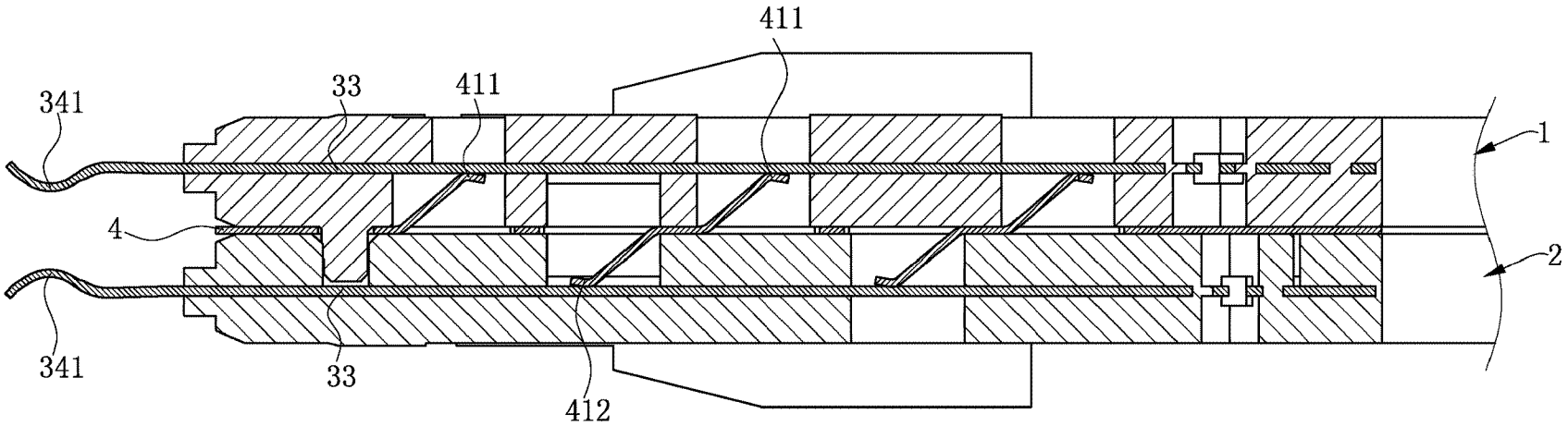
FIG. 9 is a sectional view of FIG. 3.

Referring to FIG. 1 and FIG. 9, the grounding sheet 4 is clamped between the upper insulating body 1 and the lower insulating body 2, and includes a body portion 41 and a plurality of upper elastic sheets 411 and a plurality of lower elastic sheets 412 respectively extending upward and downward from the body portion 41. The upper elastic sheets 411 and the lower elastic sheets 412 are alternately provided in the front-rear direction, and the upper elastic sheets 411 and the lower elastic sheets 412 are correspondingly in contact with the grounding terminals 33 in the upper row and the lower row, so as to achieve a better shielding function.

Referring to FIG. 1, the clamping member 5 is provided with a flat plate portion 51, two clamping arms 52 extending from a same side of the flat plate portion 51, and a clamping block 53 protruding from a surface of the flat plate portion 51. When the upper insulating body 1 and the lower insulating body 2 are assembled together, the clamping arms 52 enter the clamping groove 14, and the clamping block 53 clamps outer surfaces of the upper insulating body 1 and the lower insulating body 2 to prevent from disengagement.

Referring to FIG. 1, the outer body 6 accommodates the upper insulating body 1 and the lower insulating body 2, and includes a rubber shell 61, metal members 62 located on two sides of the rubber shell 61, and a shielding shell 63 wrapping an exterior of the rubber shell 61. The rubber shell 61 accommodates the upper insulating body 1 and the lower insulating body 2. A center of the rubber shell 61 is provided with a plug port 611 for a mating element to be plugged therein, and two opposite upper and lower sides of the plug port 611 are provided with a plurality of reserved grooves 612 used to reserve spaces for the terminals 3 when the terminals 3 are in contact with the mating element. The metal members 62 are mounted at two sides of the plug port 611, and are used to guide the mating element to plug in and preventing from damage to the rubber shell 61 when the mating element is plugged in. A mounting portion 631 is protrudingly provided on an outer surface of the shielding shell 63, and screws and other fixing elements can be used to fix the electrical connector 100 with holes in the mounting portion 631 and the circuit board 200.

Figure 10:
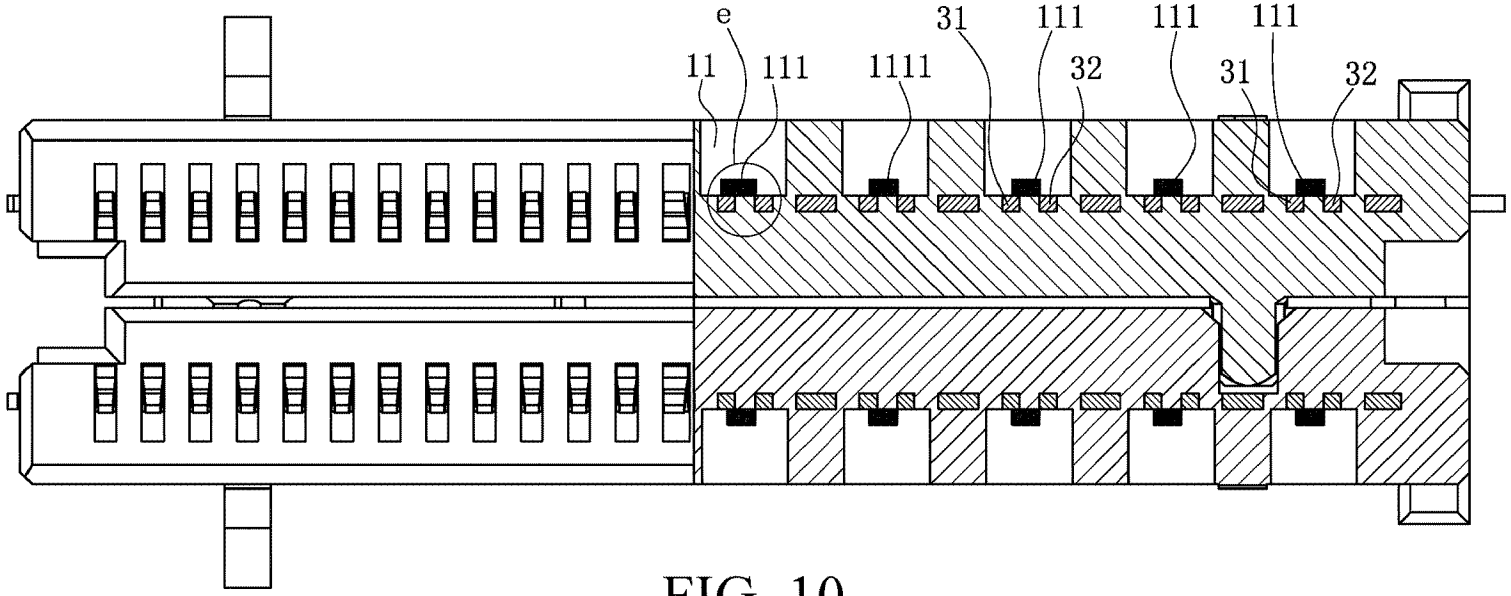
FIG. 10 is a sectional view of a second embodiment of the present invention.
Figure 11:
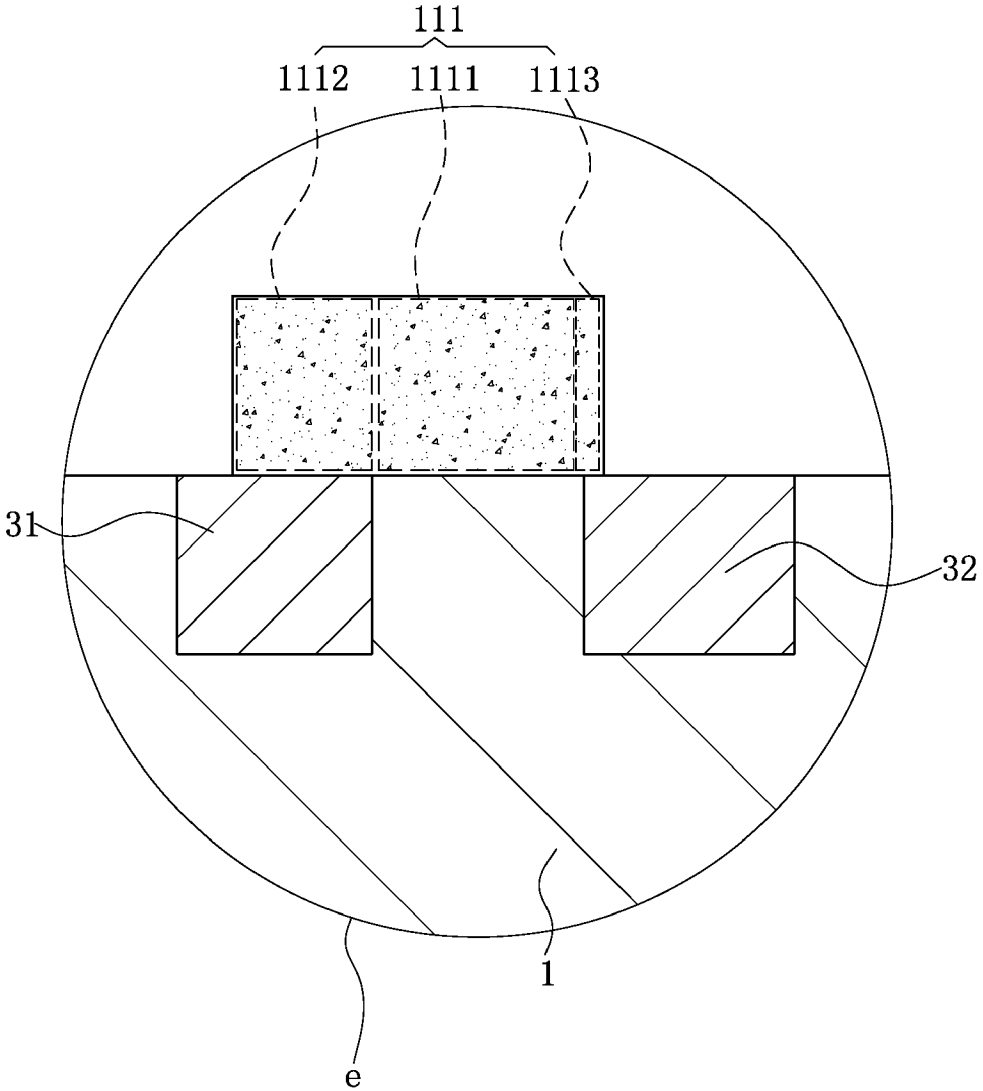
FIG. 11 is a partial enlarged view of FIG. 10.

FIG. 10 and FIG. 11 show an electrical connector 100 according to second embodiment of the present invention. In this embodiment, using a first protruding block 111 located at the innermost side as an example, the difference from the first embodiment exists in that, in addition to the protruding portion 1112 extending from the base 1111, the protruding block 111 further includes a protruding extending portion 1113 extending from the base 1111 toward a direction opposite to the protruding portion 1112, and the protruding extending portion 1113 covers a small portion of the long signal terminal 32.

To sum up, the electrical connector 100 according to certain embodiments of the present invention has the following beneficial effects:

1. The upper insulating body 1 is concavely provided with the first grooves 11, the second grooves 12 and the third grooves 13 to expose the long signal terminal 32 and the short signal terminal 31 in air, such that a dielectric constant is changed to adjust impedance, so as to improve the high frequency characteristics.

2. The area of the short signal terminal 31 covered by the first protruding block 111 is larger than the area of the long signal terminal 32 covered by the first protruding block 111, which sets an obstruction for the short signal terminal 31. When the short signal terminal 31 and the long signal terminal 32 simultaneously receive signals, the time for the short signal terminal 31 to transmit the signal can be prolonged, such that the delay skew caused by a length difference of the long signal terminal 32 and the short signal terminal 31 can be eliminated.

3. The proportions of the short signal terminals 31 located at the inner side covered by the first protruding blocks 111, the second protruding blocks 121 and the third protruding blocks 131 are larger than the proportions of the short signal terminals 31 located at the outer side covered by the first protruding blocks 111, the second protruding blocks 121 and the third protruding blocks 131, such that a larger obstruction can be provided for the short signal terminals 31 with a relatively small length and located at the inner side, and the effect of eliminating the delay skew is better guaranteed.

4. The proportions of the short signal terminals 31 covered by the first protruding blocks 111, the second protruding blocks 121 and the third protruding blocks 131 are gradually increased from outside to inside, so as to achieve better effects of eliminating the delay skew and resolving a high frequency problem.

5. The first protruding block 111 is provided with the protruding portion 1112 and the protruding extending portion 1113 which correspondingly cover the short signal terminal 31 and the long signal terminal 32. Under an actual condition, the applicable environment and the actual requirements for signal transmission are different, and the first protruding block 111 may provide an excessively large obstruction for the short signal terminal 31. In this case, a smaller portion of the short signal terminal 31 can be covered by reducing a width of the protruding portion 1112, or under a condition that the protruding portion 1112 is not changed, the protruding extending portion 1113 is provided to cover a small portion of the long signal terminal 32.

6. The first protruding block 111 is integrally formed with the upper insulating body 1 and linearly extends from front to back so as to connect the two oppositely-arranged inner surfaces of the first groove 11, and the height of the upper surface of the first protruding block 111 is smaller than that of the outer surface of the upper insulating body 1, such that manufacturing is simple, and the effect of eliminating the delay skew is good.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, comprising:

an insulating body; and a plurality of pairs of signal terminals adjacently provided and accommodated in the insulating body, wherein the pairs of signal terminals are arranged from inside to outside in a transverse direction, each of the pairs of signal terminals comprises a long signal terminal and a short signal terminal, each of the long signal terminal and the short signal terminal has a first section and a second section bending and extending from one end of the first section, a length of the long signal terminal is greater than a length of the short signal terminal, a length of a short signal terminal located at an outer side is greater than a length of a short signal terminal located at an inner side, an area of the long signal terminal covered by the insulating body is smaller than an area of the short signal terminal covered by the insulating body, a proportion of the short signal terminal located at the inner side covered by the insulating body is larger than a proportion of the short signal terminal located at the outer side covered by the insulating body, and proportions of the short signal terminals covered by the insulating body are gradually increased from outside to inside.

2. The electrical connector according to claim 1, wherein the first section of the short signal terminal and the first section of the long signal terminal are correspondingly provided in parallel, and the second section of the short signal terminal and the second section of the long signal terminal are correspondingly provided in parallel.

3. An electrical connector, comprising:

an insulating body, provided with at least one groove, wherein at least one protruding block is provided in the at least one groove; and at least one pair of signal terminals adjacently provided, accommodated in the insulating body and exposed in the at least one groove, wherein each of the at least one pair of signal terminals comprises a long signal terminal and a short signal terminal, each of the long signal terminal and the short signal terminal has a first section and a second section bending and extending from one end of the first section, a length of the long signal terminal is greater than a length of the short signal terminal, and an area of the short signal terminal covered by the protruding block is larger than an area of the long signal terminal covered by the protruding block.

4. The electrical connector according to claim 3, wherein the protruding block only covers the short signal terminal and does not cover the long signal terminal.

5. The electrical connector according to claim 3, wherein the protruding block covers a portion of the long signal terminal.

6. The electrical connector according to claim 3, wherein a portion of the short signal terminal is exposed in the at least one groove, and the protruding block does not completely cover the portion of the short signal terminal.

7. The electrical connector according to claim 3, wherein the first section of the short signal terminal comprises a contact portion and a first connecting portion extending backward from the contact portion, the at least one groove comprises a first groove, the first connecting portion is exposed in the first groove, and an area of the first connecting portion covered by the protruding block is gradually increased from front to back.

8. The electrical connector according to claim 3, wherein the first section of the short signal terminal comprises a contact portion and a first connecting portion extending backward from the contact portion, the at least one groove comprises a first groove, the first connecting portion is exposed in the first groove, and a rear end of the first connecting portion is located closer to a side edge of the protruding block relative to a front end of the first connecting portion.

9. The electrical connector according to claim 3, wherein the at least one groove comprises a first groove, the protruding block comprises a first protruding block, the first protruding block is located in the first groove, and the first protruding block linearly extends from front to back so as to connect two inner surfaces of the first groove opposite to each other.

10. The electrical connector according to claim 3, wherein the short signal terminal located at an outermost side has a width, and more than half of the width is not covered by the protruding block.

11. The electrical connector according to claim 3, wherein the at least one groove comprises a first groove and a second groove, a first protruding block and a second protruding block are respectively provided in the first groove and the second groove, and the first protruding block and the second protruding block are staggeredly provided in a front-rear direction and cover a same short signal terminal.

12. The electrical connector according to claim 11, wherein the first section of the short signal terminal comprises a contact portion and a first connecting portion extending backward from the contact portion, the first connecting portion extends backward to form a second connecting portion, the first connecting portion is located in the first groove, the second connecting portion is exposed in the second groove, and a distance between a side edge of a front end of the first connecting portion and the first protruding block is greater than a distance between a side edge of the second connecting portion and a side edge of the second protruding block.

13. The electrical connector according to claim 3, wherein the first section of the short signal terminal and the first section of the long signal terminal are correspondingly provided in parallel, and the second section of the short signal terminal and the second section of the long signal terminal are correspondingly provided in parallel.

14. The electrical connector according to claim 3, comprising a plurality of pairs of signal terminals, wherein the insulating body is provided with a plurality of grooves and a plurality of protruding blocks, each of the pairs of the signal terminals is exposed to a corresponding one of the grooves, each of the grooves is provided with a corresponding one of the protruding blocks correspondingly covering a portion of the short signal terminal of a corresponding pair of the signal terminals, the pairs of signal terminals are arranged from inside to outside in a transverse direction, a length of a short signal terminal located at an outer side is greater than a length of a short signal terminal located at an inner side, and an area of the portion of the short signal terminal located at the inner side covered by the corresponding protruding block is larger than an area of the portion of the short signal terminal located at the outer side covered by the corresponding protruding block.

15. The electrical connector according to claim 14, wherein areas of the portions of the short signal terminals covered by the protruding blocks are gradually decreased from inside to outside.

16. The electrical connector according to claim 14, wherein a proportion of the area of the portion of the short signal terminal located at the inner side covered by the corresponding protruding block is larger than a proportion of the area of the portion of the short signal terminal located at the outer side covered by the corresponding protruding block.

17. The electrical connector according to claim 14, wherein proportions of areas of the portions of the short signal terminals covered by the protruding blocks are gradually increased from outside to inside.

* * * * *